US006447109B1

(12) United States Patent
Williamson et al.

(10) Patent No.: US 6,447,109 B1
(45) Date of Patent: Sep. 10, 2002

(54) LIQUID INK CARTRIDGE AND IMPROVED FILLING METHOD

(75) Inventors: Holly M. Williamson, Penfield; Dennis M. Lengyel, Hemlock; Steven J. Dietl, Ontario; Hiep H. Nguyen, Rochester, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/905,309

(22) Filed: Jul. 13, 2001

(51) Int. Cl.[7] ..... B41J 2/175
(52) U.S. Cl. ..... 347/85; 347/86
(58) Field of Search ..... 347/84, 85, 86, 347/87; 141/48

(56) References Cited

U.S. PATENT DOCUMENTS

| | | | | |
|---|---|---|---|---|
| 5,289,212 A | | 2/1994 | Carlotta | 347/87 |
| 5,509,140 A | | 4/1996 | Koitabashi et al. | 347/86 |
| 5,732,751 A | * | 3/1998 | Schmidt et al. | 141/48 |
| 5,875,615 A | | 3/1999 | Ito et al. | 53/474 |
| 5,953,030 A | | 9/1999 | Ishinaga et al. | 347/86 |
| 5,997,121 A | | 12/1999 | Altfather et al. | 347/7 |
| 6,231,172 B1 | | 5/2001 | Koitabashi et al. | 347/86 |
| 6,250,749 B1 | | 6/2001 | Merz et al. | 347/86 |
| 6,254,226 B1 | | 7/2001 | Lengyel et al. | 347/86 |
| 6,254,227 B1 | | 7/2001 | Merz et al. | 347/86 |

FOREIGN PATENT DOCUMENTS

JP 08090783 4/1996

OTHER PUBLICATIONS

Steven Dietl, Thomas Binnert, Kenneth Altfather, and Vladimir Kupchick, Ink Container With Improved Sealing of Ink Container Outlet Port, U.S. Ser. No. 09/056,031, filed on Apr. 6, 1998.

* cited by examiner

*Primary Examiner*—Anh T.N. Vo
(74) *Attorney, Agent, or Firm*—David J. Arthur

(57) ABSTRACT

A fluid cartridge, such as a cartridge for filling with ink for use in ink jet printhead includes a wick chamber that has outer walls, and forms a wick chamber and a fluid chamber. The outer walls of the fluid chamber are formed to provide no fluid communication with the fluid chamber except through the wick chamber. The ink fluid cartridge is filled by evacuating gas from the ink chamber and from the wick chamber, and then supplying ink into the wick chamber until the ink substantially saturates the wick material, and flows into the ink chamber.

9 Claims, 9 Drawing Sheets

LIQUID INK CARTRIDGE AND IMPROVED FILLING METHOD

BACKGROUND OF THE INVENTION

The present invention relates to ink cartridges used for supplying liquid ink to a printhead in a thermal ink jet printing apparatus. Specifically, the present invention relates to structure and methods for filling and venting the ink tank of an ink supply cartridge in a thermal ink jet printing apparatus.

Thermal ink jet printing is well understood in the art. U.S. Pat. No. 5,997,121 describes several aspects of such printing. In existing thermal ink jet printers, the printhead comprises one or more ink filled channels communicating with a relatively small supply chamber, or manifold, at one end, and having an opening at the opposite end, referred to as a nozzle. In current practical embodiments of drop on demand thermal ink jet printers, it has been found that the printers work most effectively when the pressure of the ink in the printhead nozzle is kept within a predetermined range of gauge pressures. Specifically, at those times during operation in which an individual nozzle or an entire printhead is not actively emitting a droplet of ink, it is important that a certain negative pressure, or "back pressure", exist in each of the nozzles and, by extension, within the ink supply manifold of the printhead. The attributes of creating and maintaining such back pressure are described in the U.S. Pat. No. 5,289,212, the contents of which are incorporated herein by reference.

The ink is supplied to the printhead from an ink cartridge. The ink cartridge contains a supply of ink, and is typically configured to maintain the required negative pressure. The ink cartridge is typically a user-replaceable unit that mates with the printhead of the printing apparatus.

SUMMARY OF THE INVENTION

In accordance with an aspect of the present invention, a fluid cartridge for supplying fluid on demand includes a wick chamber that has a plurality of outer walls defining an interior that includes a wick chamber. An outlet opening extends through one of the outer walls of the wick chamber, and a vent opening through an outer wall of the wick chamber. The fluid cartridge additionally includes a fluid chamber having a plurality of outer walls, a fluid conduit between the fluid chamber and the wick chamber. The outer walls of the fluid chamber are formed to provide no fluid communication with the fluid chamber except through the wick chamber.

In accordance with another aspect of the present invention, a method of filling a cartridge for supplying liquid ink on demand to an ink jet printhead is provided. The cartridge includes a housing defining a wick chamber and an ink chamber, with a fluid conduit between the ink chamber and the wick chamber. The housing contains wick material in the wick chamber, and has a fluid opening through the housing into the wick chamber. The method of the present invention includes sealing the ink chamber, evacuating gas from the ink chamber and the wick chamber, and supplying ink through the fluid opening into the wick chamber until the ink flows through the fluid conduit into the ink chamber.

DETAILED DESCRIPTION

Figure 1:
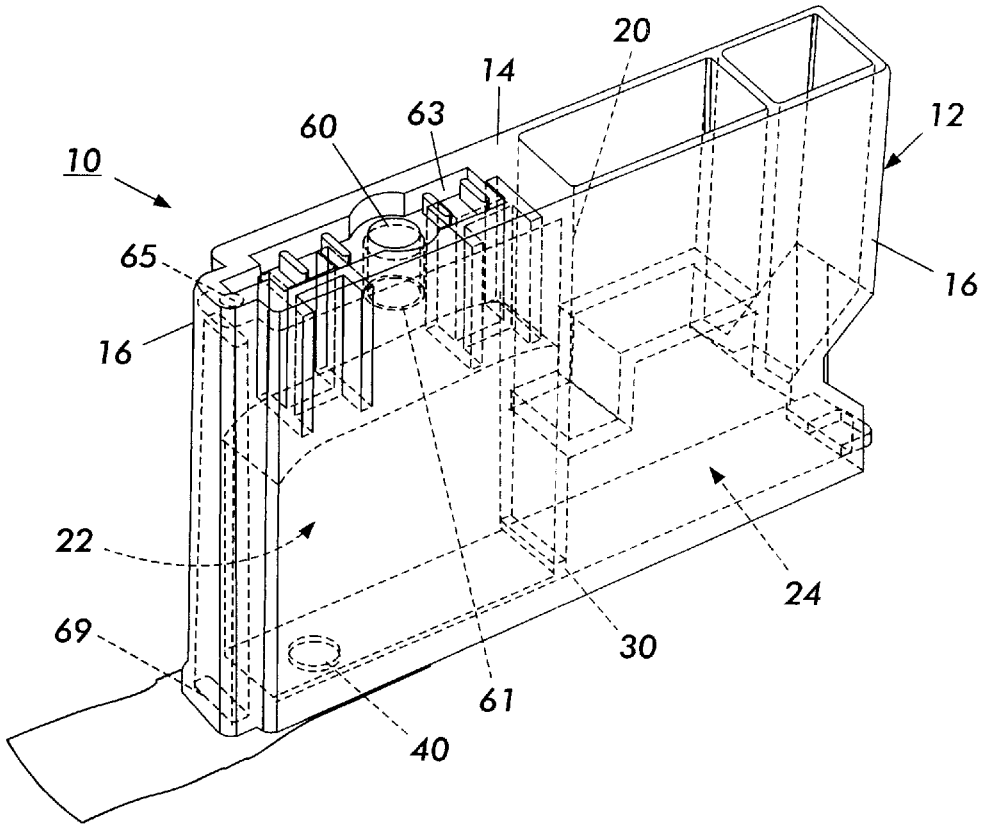
FIG. 1 is a perspective view of an exemplary ink cartridge incorporating a particular embodiment of an aspect of the present invention showing the internal structure thereof in phantom.
Figure 2:
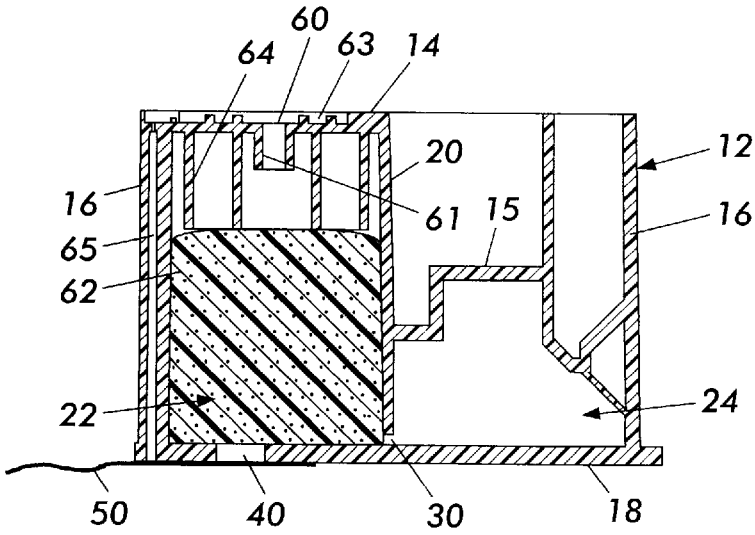
FIG. 2 is a side cross-sectional view of the ink cartridge of FIG. 1.

Referring to FIGS. 1 and 2, a fluid cartridge 10 incorporating one embodiment of an aspect of the present invention includes a housing 12 formed of a plurality of walls 14, 15, 16, 18. In the particular embodiment illustrated, the walls of the housing include a top wall 14, 15 and a substantially parallel and opposed bottom wall 18. Four side walls 16 complete the housing. The top wall 14 and side walls 16 of the housing may be integrally formed as a single unit molded plastic, and the bottom wall 18 may be a separate molded piece attached to the structure with glue, by ultrasonic welding, or other known techniques. The walls thus enclose a substantially hollow housing interior. In FIG. 1, a representative internal structure of the cartridge is shown in phantom lines. FIG. 2 is a side view in cross section.

The interior of the housing contains a wick chamber 22 and a fluid or ink chamber 24. A divider 20 extends from the top wall 14 toward the bottom wall 18, and also extends between two opposing side walls 16, to divide the hollow housing interior into the wick chamber and the fluid or ink chamber.

A fluid conduit 30 provides fluid communication between the ink chamber and the wick chamber. In the embodiment particularly described and shown, the fluid conduit between the wick chamber and the ink chamber is a gap in the divider 20, adjacent the bottom wall 18 of the housing. However, those skilled in the art will recognize that other types of fluid conduit (such as a different type of opening through the divider 20, a tube, or other structure) between the ink chamber 24 and the wick chamber 22 may be provided. The fluid conduit 30 between the ink chamber and the wick chamber is close to the bottom of the ink chamber.

An outlet opening 40 through one of the walls forming the housing for the wick chamber provides the point at which the cartridge interacts with the printhead, and through which ink is supplied from the cartridge to the ink jet printhead. In the embodiment shown in FIGS. 1 and 2, the outlet opening 40 is in the bottom wall 18 of the wick chamber, which is substantially opposed to the top wall 14. However, the outlet opening may also be provided through one of the side walls of the housing. An outlet seal 50 covers the outlet opening 40 prior to the time at which the cartridge is installed in the printhead of the printing apparatus. For example, metallic tape or foil with a polypropylene backing, or other material that the ink cannot penetrate is placed on the outer surface of the wall having the outlet opening to cover the outlet opening, and sealed to the outer surface of the bottom wall. The seal 50 is removable, so that the user can remove it before inserting the cartridge into the printhead. An extended end of the seal 50 extending beyond the end of the bottom wall 18 allows a user to grasp and remove the tape from the bottom wall 18 when the user is ready to install the cartridge in the printhead. However, in certain configurations, the seal may remain in place, and be punctured or otherwise penetrated by the printhead when the cartridge is installed for use in the printing apparatus.

An ink retaining member, such as a wick 62, substantially fills the interior of the wick chamber 22. The wick material uses capillary action to retain the ink, and is well understood by those familiar with the art. For example, polyether foam material may be used as the wick 62. When saturated with liquid (such as ink), the capillary action of the wick material facilitates maintaining the negative pressure for proper operation of the printhead. Therefore, the specific material may be different for different print apparatus configurations. Those skilled in the art will recognize that the materials may be used to provide the appropriate capillary action.

The ink chamber 24 has no ink retaining material. Liquid ink is stored in the ink chamber 24. During use of the container, liquid ink is transferred from the ink chamber 24 to the wick 62 through the fluid conduit 30. The ink is released through the outlet opening 40 as necessary to supply the printhead with ink for printing.

Extending from the fluid conduit opening 30 upward along the wick chamber side of the divider 20 are vertical grooves 66. These vertical grooves may be approximately ⅜inch (1.0 cm) in length. The grooves assist in conducting ink from the ink chamber into the wick material in the wick chamber.

A combination fill hole and vent opening 60 extends through one of the outer walls of the wick chamber. In the embodiment illustrated in FIGS. 1–3, the fill hole/vent opening 60 extends through the top wall 14 of the wick chamber. Surrounding the vent opening 60 and extending into the wick chamber 22 is a vent tube 61.

Projections, such as ribs 64, extend vertically from the top wall of the housing into the wick chamber 22. The ribs 64 extend farther into the wick chamber than does the vent tube 61. For example, the ribs may extend into the interior of the wick chamber two or three times as far as the vent tube. Thus, the vent tube may extend 0.10 in (0.25 cm) into the wick chamber, and the ribs extend 0.20 in (0.50 cm). In another configuration, the vent tube may extend 0.20 in (0.50 cm) into the wick chamber, and the ribs extend 0.40 in (1.0 cm). The ribs 64 prevent the wick material from contacting the vent tube and maintain an air gap between the top of the wick material 62 and the lower edge of the fill tube or vent tube 61.

In accordance with a particular embodiment of the ink cartridge, the ribs 64 are H shaped in cross-section. However, after reading the present description, those skilled in the art will recognize that numerous other shapes may be used. Among the other shapes possible are (referring to their crosssectional shape) Z, I, curved, and other shapes.

The housing walls forming the fluid or ink chamber are integrally formed or sealed so that there is no fluid communication between the chamber and the ambient environment, except through the wick chamber. The fluid conduit 30 between the wick chamber and the ink chamber may be the only opening into the ink chamber 24. In the preferred embodiment, the top and side walls 15, 16 of the ink chamber portion 24 of the housing are integrally formed with no openings. The top and side walls 15,16 may be molded of a plastic material such as polypropylene, using injection molding techniques. However, those skilled in the art will recognize that other materials and manufacturing techniques may be used to form the housing.

The bottom wall 18 is solid across the ink chamber portion of the housing and is securely sealed to the bottom edge of the side walls 16 of the housing. However, depending on the volume desired for the ink chamber, the walls of the ink chamber may be formed in other manners. For example, a horizontal top wall 15 for the ink chamber may be molded between the side walls at a point lower than the top wall 14 of the wick chamber. The top wall of the ink chamber so formed need not be horizontal, nor flat, and may include steps or other shapes.

In accordance with a particular embodiment of the cartridge, the top wall 14 of the wick chamber includes a recessed portion 63 surrounding the vent opening 60. The recess 63 in the outer surface of the top wall 14 is in fluid communication with an overflow conduit 65. In the particular embodiment illustrated, the overflow conduit comprises a tube integrally formed along one side wall of the housing, with one end of the overflow tube 65 at the recess 63, and the other end coinciding with an opening 69 through the bottom wall 18, near the cartridge outlet opening 40. Detailed descriptions of particular embodiments of the recess 63 and of the overflow tube 65 are contained in the patent, LIQUID INK CARTRIDGE WITH RECESSED FILL HOLE AND INK TANK VENT, U.S. Pat. No. 6,254,226, naming inventors Dennis Lengyel and Hiep Nguyen, INK CARTRIDGE WITH SPILLOVER DAM, U.S. Pat. No. 6,254,227, naming inventors Eric Merz and Hiep Nguyen, and INK CARTRIDGE WITH OVERFLOW CONDUIT, U.S. Pat. No. 6,250,749, naming inventors Edward Carrese, Dennis Lengyel, Eric Merz and Hiep Nguyen, all filed on Jul. 14, 2000, and assigned to the same assignee as the assignee of the present application, which applications are hereby incorporated by reference.

A top seal (not shown) such as metallic tape, foil, or other material that is impervious to the liquid ink covers the recess 63 in the top wall of the housing. The tape is bonded to the raised (non-recessed) portions of the outer surface of the top wall 14, so that the tape does not seal or close off the vent opening 60. When the outlet seal 50 closes the end 69 of the overflow tube, and the top seal 80 is applied, the interior of the housing is thereby sealed from the ambient environment.

Figure 3:
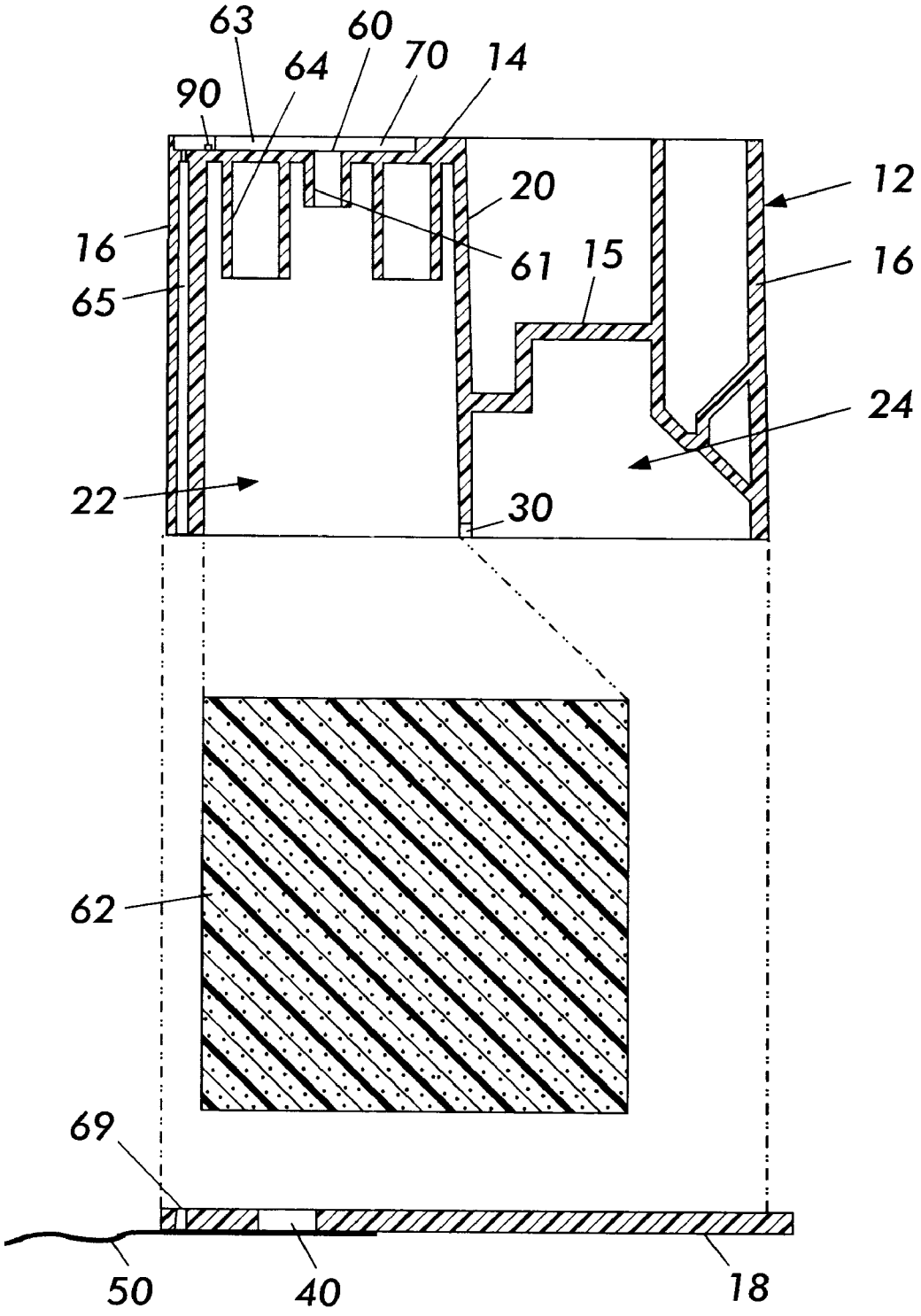
FIG. 3 is an exploded cross-sectional view of the ink cartridge of FIG. 2.
Figure 4:
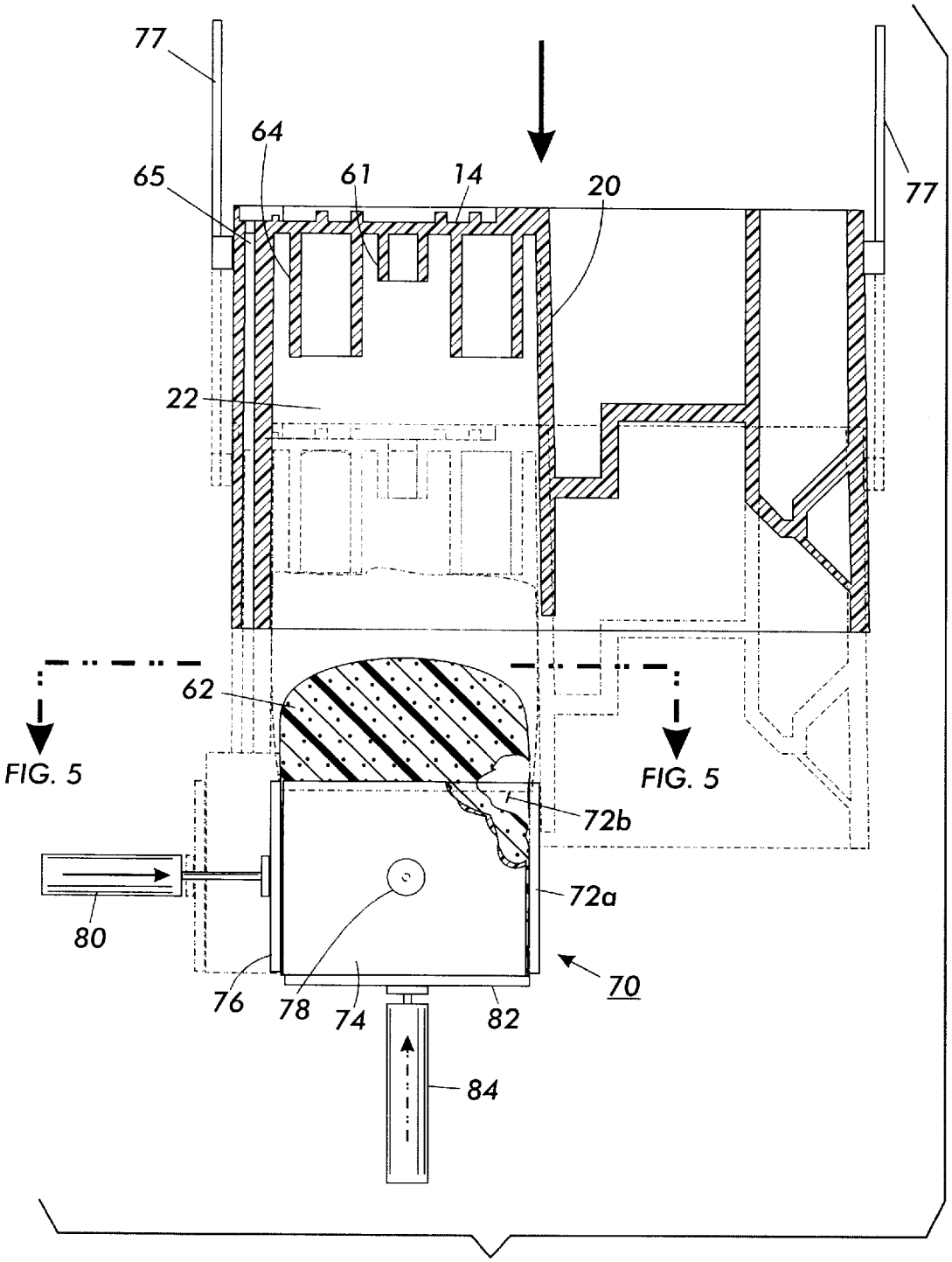
FIG. 4 is a side cross-sectional view of the ink cartridge of FIGS. 1 and 2 before insertion of the wick material.
Figure 5:
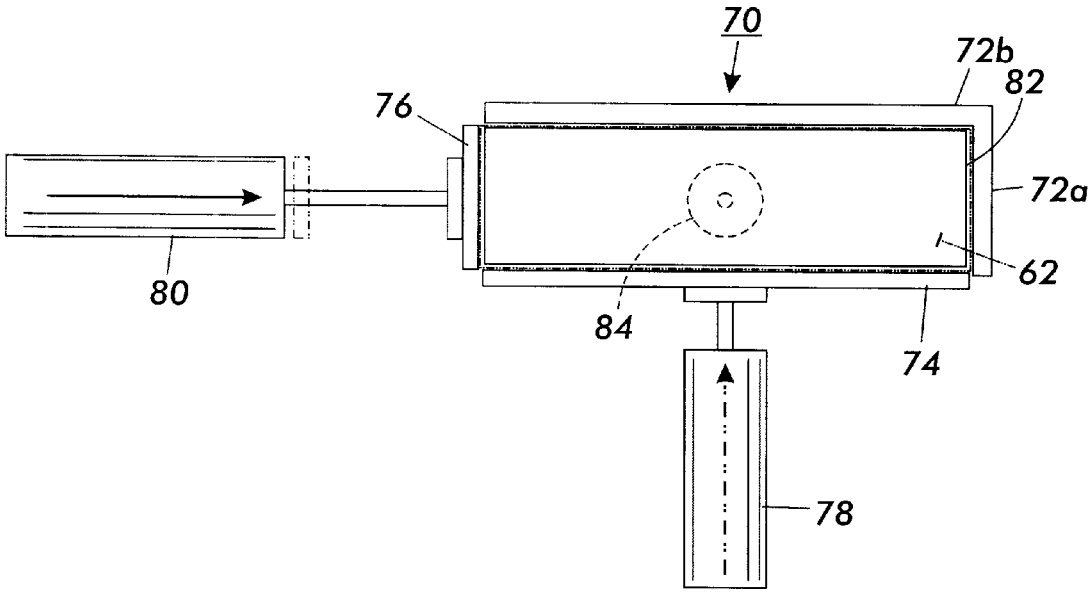
FIG. 5 is an end view of the wick material and a compression fixture, taken along line 5—5 of FIG. 4.

As seen in FIG. 3, the wick material 62, in an uncompressed state, is considerably larger than the interior of the wick chamber 22. The wick 62 is initially a rectangular block of the wick material. To insert the foam material into the wick chamber 22, the wick is compressed by a compression fixture 70 to a size smaller than the interior of the wick chamber 22 as shown in FIGS. 4 and 5. FIG. 4 shows the wick material compressed by the compression fixture and prepared for insertion into the wick chamber 22 of the ink cartridge.

Referring next to FIG. 5, the compression fixture includes a corner element 72 and two side fingers 74, 76. For the compression fixture to compress the wick material for insertion into the wick chamber, the wick material is placed near or against the corner element 72, as seen in the view of FIG. 5, which is from above the wick material. The side of the wick that is to be adjacent the divider 20 of the cartridge housing (see FIG. 2) is placed against one leg 72*a* of the corner element. The first finger 74 presses against the side of the wick to compress the wick material laterally between the first finger 74 and the second leg, 72*b* of the corner element. After the first finger 74 has laterally compressed the wick material, a second finger 76 presses against the wick, compressing the wick longitudinally against the first leg 72*a* of the corner element 72. Friction between the surface of the wick material and the elements 72, 74 of the compression fixture causes the wick to be more compressed nearer the second finger 76 than near the first leg 72*a* of the corner element. Different mechanisms can be used to move the fingers 74, 76 to compress the wick, such as a screw drive, hydraulic drive, or pneumatic drive. For example, an air cylinder may drive the shaft of each finger.

The compression fixture inserts the compressed wick material at least partway into the wick chamber 22 of the housing. For example, the compression fixture may insert the compressed wick (and the corner element 72 and the fingers 74, 76 of the compression fixture) about half-way into the wick chamber, as indicated by the phanton lines of FIG. 4. In one implementation, fingers 77 holding the ink cartridge housing lower the housing over the compressed wick material, the corner element 72, and the fingers 74, 76. The air cylinders 78, 80 holding the fingers 74, 76 against the wick are released. The wick slightly expands, although the fingers do not completely release the wick, as the fingers 74, 76 are constrained within the interior of the wick chamber. A plunger 82 then presses the wick 62 the remainder of the way into the wick chamber. The compression fixture withdraws the fingers 74, 76 from the interior of the wick chamber while the plunger 82 holds the wick material in place in the wick chamber.

Figure 6:
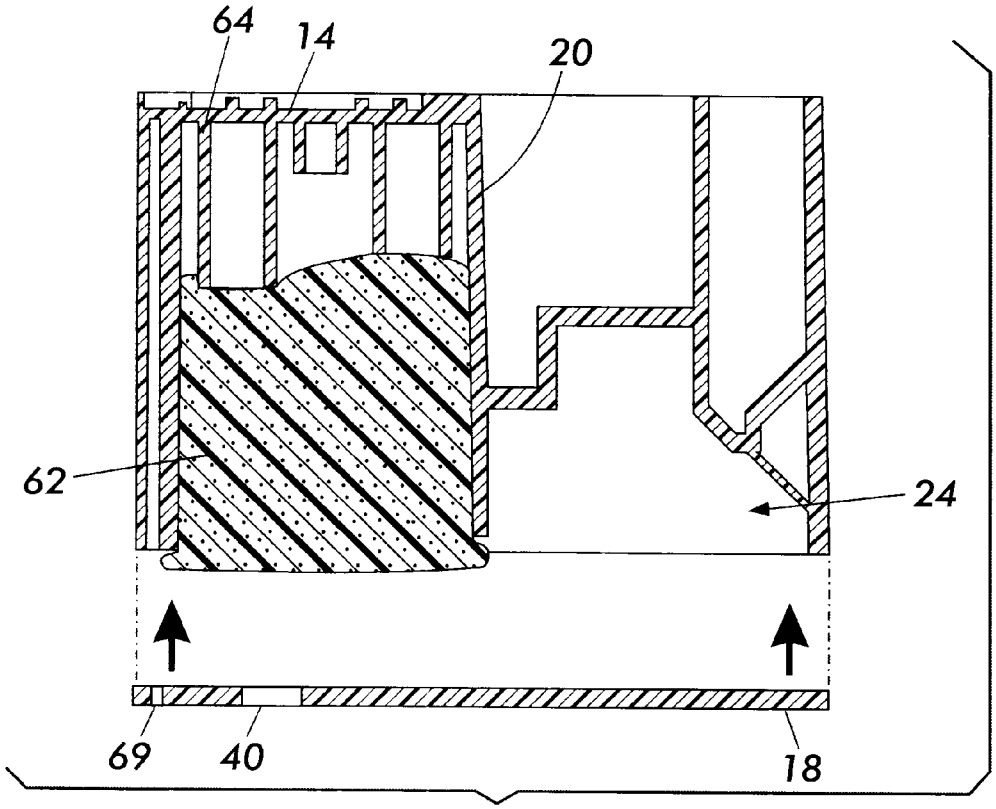
FIG. 6 is a cross-sectional view of the ink jet cartridge shown in FIG. 4 showing the cartridge partially assembled.

The compression fixture then removes the plunger 82, and the cover wall 18 is placed over the open side of the wick chamber 22 (and the free ink chamber 24). In a particular implementation, to obtain increased wick density adjacent the cover wall, when the wick 62 is inserted into the wick chamber 22, a small portion (1.5–3.0 mm) of the wick material remains extending beyond the open end of the wick chamber 22, as seen in FIG. 6. Then, when the cover wall 18 is applied over the open side of the housing, to enclose the interior space of the housing, the cover wall 18 completes the compression of the wick material adjacent the open side of the housing. Thus, after the cover wall is sealed to the housing body, the wick material adjacent the cover wall 18 has a higher density than does wick material away from the cover wall 18.

Figure 7:
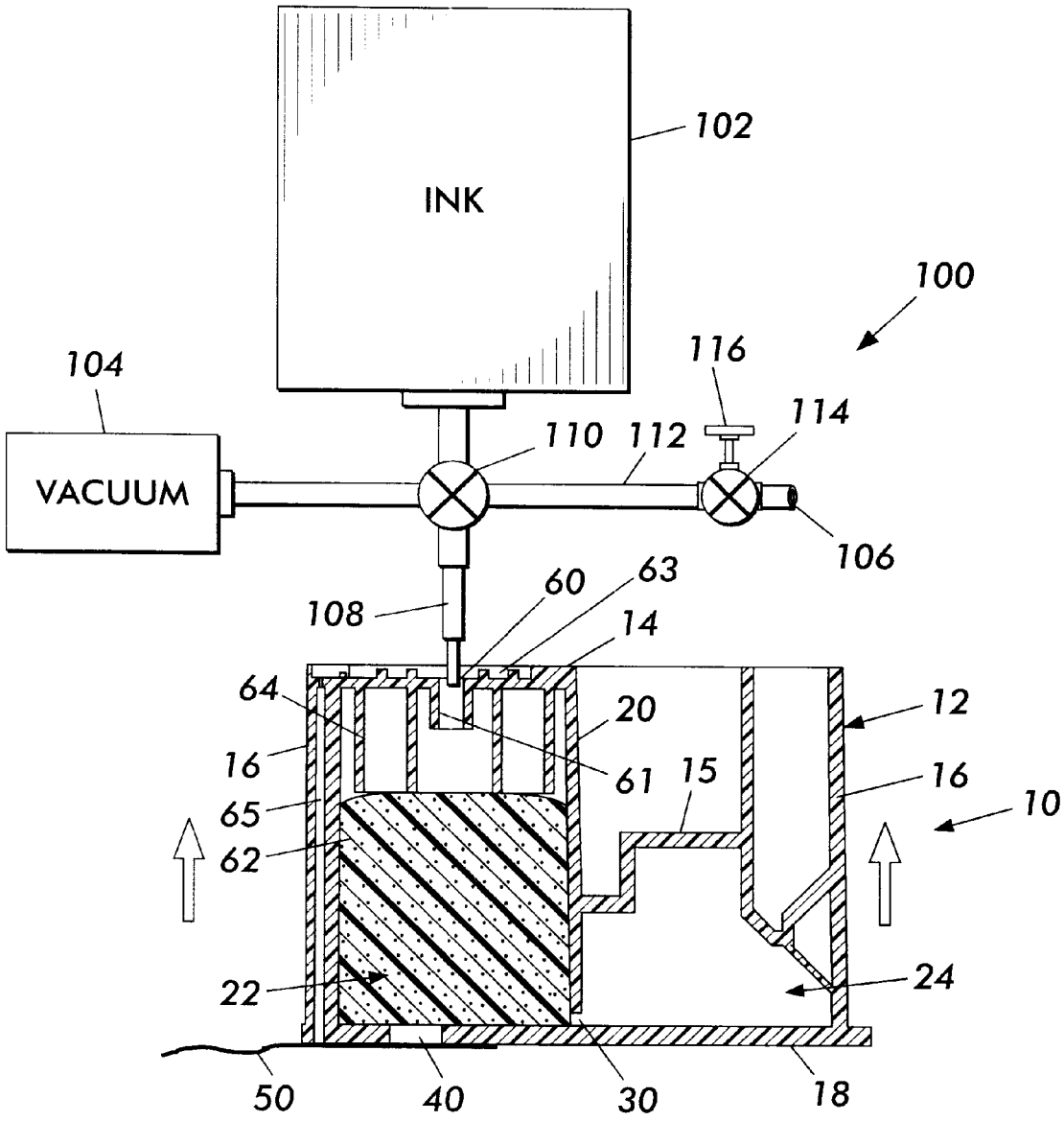
FIG. 7 is a schematic view of an ink tank together with a mechanism for filling the ink tank with ink in accordance with an aspect of the present invention.

In accordance with an aspect of the present invention, a fluid cartridge as described above can be filled through the vent opening 60 provided in the wick chamber. Referring now to FIG. 7, a filling apparatus 100 includes an ink source 102 and a vacuum source or generator 104. The filling apparatus may further include an external vent 106 to atmospheric pressure. The filling apparatus includes a probe 108 adapted to mate with the vent opening 60 of the ink cartridge 10. A multi-directional valve 110 selectively connects the vacuum source 104, the ink source 102, or the external vent 106 to the probe.

To fill the ink tank with ink, the probe 108 is attached to the vent opening 60 to form a substantially air tight seal between the probe and the vent opening. The valve 110 is adjusted to connect the vacuum source 104 to the probe 108. The vacuum source 104 then withdraws gases, such as air, from the interior of the cartridge, drawing the air both from the wick material 62 in the wick chamber 22, and from the ink chamber 24 through the fluid conduit 30. The vacuum source draws as much of the air from the interior of the cartridge housing as possible or as practical. In a practical production environment, it is usually not possible to draw all of the air from the interior of the cartridge housing. Nevertheless, the more air withdrawn from the interior of the housing, the more ink can be placed in the chambers of the cartridge.

After the air has been withdrawn from the interior of the cartridge, the valve 110 is shifted to disconnect the vacuum source 104 from the probe, and to connect the ink supply 102 to the probe 108. Ink is then ejected through the probe into the cartridge. The ink initially saturates or substantially saturates the wick material 62. Once the ink saturates the wick material, the ink flows through the fluid conduit 30 into the ink chamber 24. Any gases or air remaining in the ink chamber after the vacuum source has completed withdrawing the air from the interior will remain as a bubble in the ink chamber, since the air has no way to escape the ink chamber. Thus, the more completely the air is evacuated from the interior of the chamber by the vacuum source, the smaller the air bubble. It is generally desirable to stop the flow of ink before the ink level in the wick chamber 22 begins to rise above the wick material 62. Excess ink above the wick material may spill through the vent opening 60 during shipment or installation of the cartridge.

Using the technique described, the air in the wick material is forced into the ink chamber after the wick material is substantially saturated with ink, leaving virtually no air in the wick material. Wick material with little or no air bubbles provides more accurate outflow of ink during use of the cartridge than is often possible when air remains trapped in the wick material.

After the cartridge has been filled with ink, the valve 110 is turned to connect the probe 108 to a vent conduit 112 for the external vent 106. A vent valve 114 on the vent conduit 112 is opened to connect the interior of the cartridge to a source of pressure, such as atmospheric pressure, to raise the pressure in the interior of the cartridge. The vent valve 114 and the external vent 106 may vent to atmospheric pressure, so that the pressure in the interior of the cartridge rises to approximately atmospheric pressure. Gas entering through the vent valve 114 raises the pressure in the interior of the cartridge at a controlled rate, rather than abruptly raising the pressure. Controlling the rate at which the pressure is raised in the cartridge reduces splashing and spilling. The vent valve may include an adjustment mechanism 116 to adjust the rate at which the vent valve 114 raises the pressure in the interior of the cartridge.

The top seal (not shown) is then applied over the recess 63 in the top wall of the housing.

Figure 8:
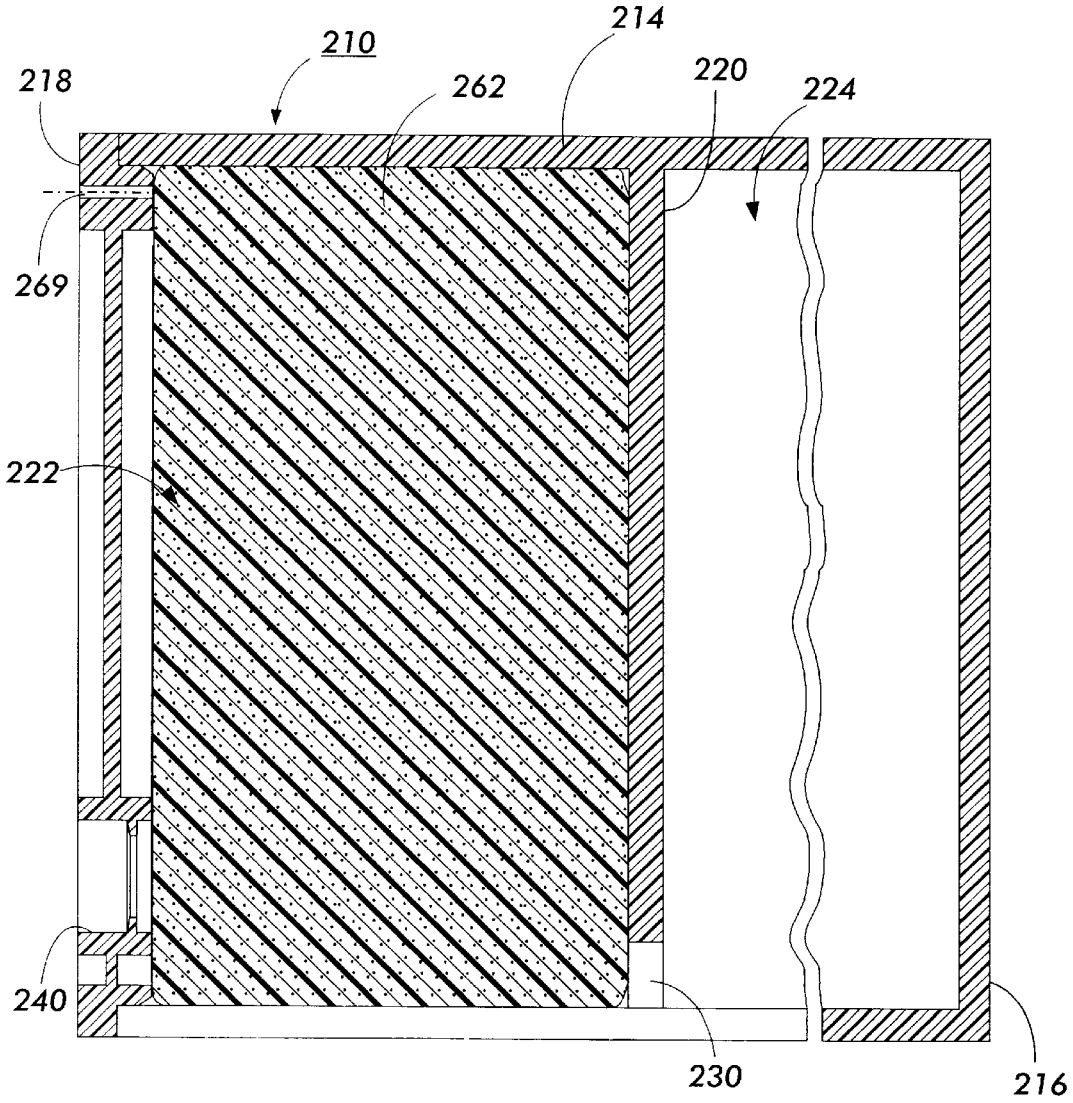
FIG. 8 is a side cross-sectional view of an ink cartridge incorporating a second embodiment of an aspect of the present invention.
Figure 9:
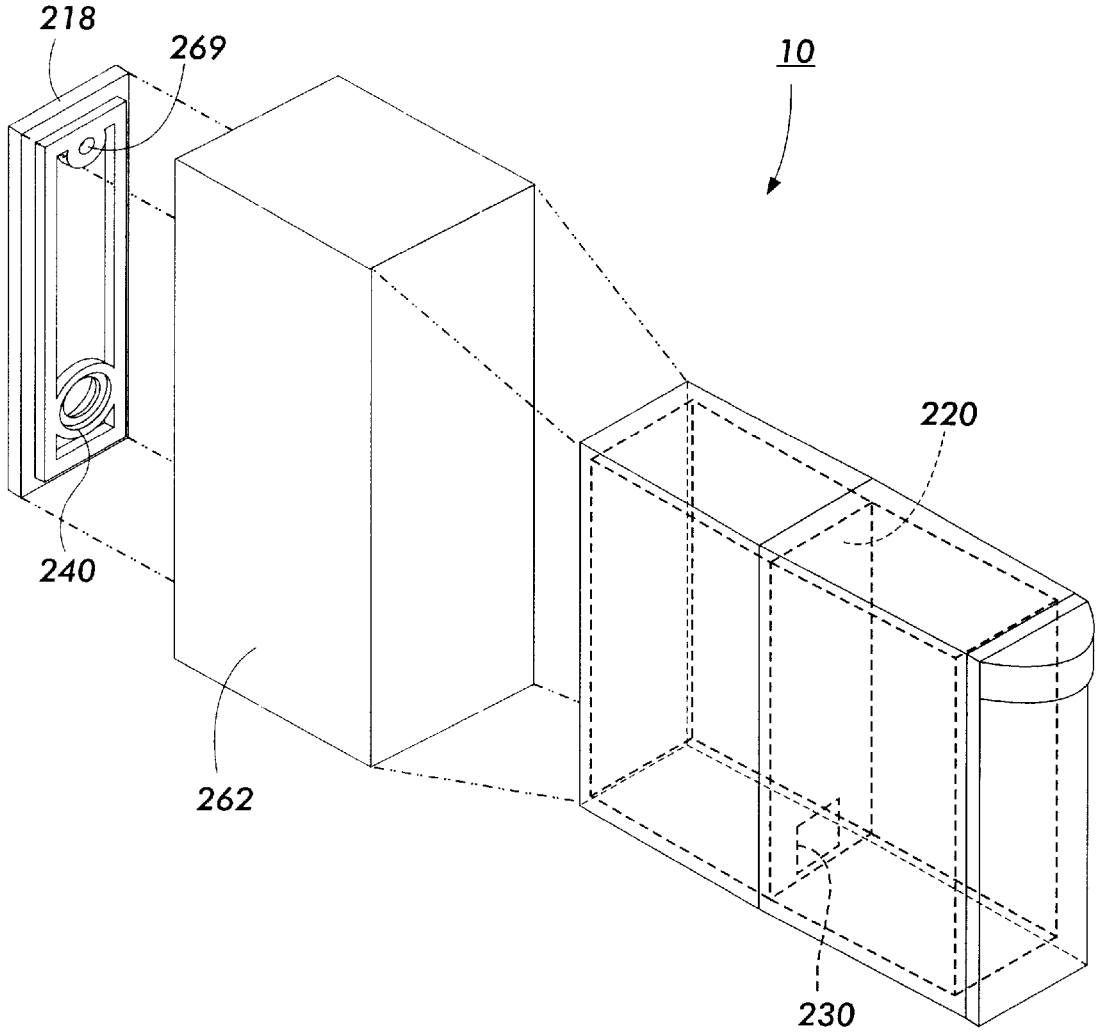
FIG. 9 is an exploded perspective view of the ink cartridge embodiment of FIG. 5.

FIGS. 8 and 9 illustrate a second embodiment of the ink tank incorporating aspects of the present invention. The cartridge of the second embodiment 210 includes a housing consisting of housing walls 214, 216, 218 with a dividing wall 220 that separates the interior of the housing into two chambers, a wick chamber 222 and an ink chamber 224. The wick chamber 222 has the wick material 262, which becomes saturated with ink. The ink chamber 224 is formed of a single molding so that it has no communication except through a fluid conduit 230 into the wick chamber. The end wall 218 of the housing has formed through it a vent opening 240 and an outlet opening 269. The end wall 218 of the housing is attached to the other walls 214, 216 of the housing with glue, ultrasonic welding, or other techniques. An embodiment of the end wall is described in the copending Patent Application, INK CONTAINER WITH IMPROVED SEALING OF INK CONTAINER OUTLET PORT, Ser. No. 09/056,031 now abandoned, naming inventors Steven Dietl, Thomas Binnert, Kenneth Alffather, and Vladimir Kupchik, and filed on Apr. 6, 1998, and assigned to the same assignee as the assignee of the present application, which application is hereby incorporated herein by reference.

Referring to the exploded view of FIG. 9, the wick material is initially significantly larger than the wick interior of the wick chamber, and is compressed as it is inserted into the wick chamber. After the wick material is inserted into the wick chamber, the end wall 218 is attached to the housing.

In accordance with an aspect of the present invention, the probe of the filling apparatus shown in FIG. 7 is applied to either the vent opening 269 or the outlet opening 240. During the evacuation and fill operation, the other opening should be closed to maintain the reduced pressure in the interior of the cartridge housing.

Figure 10:
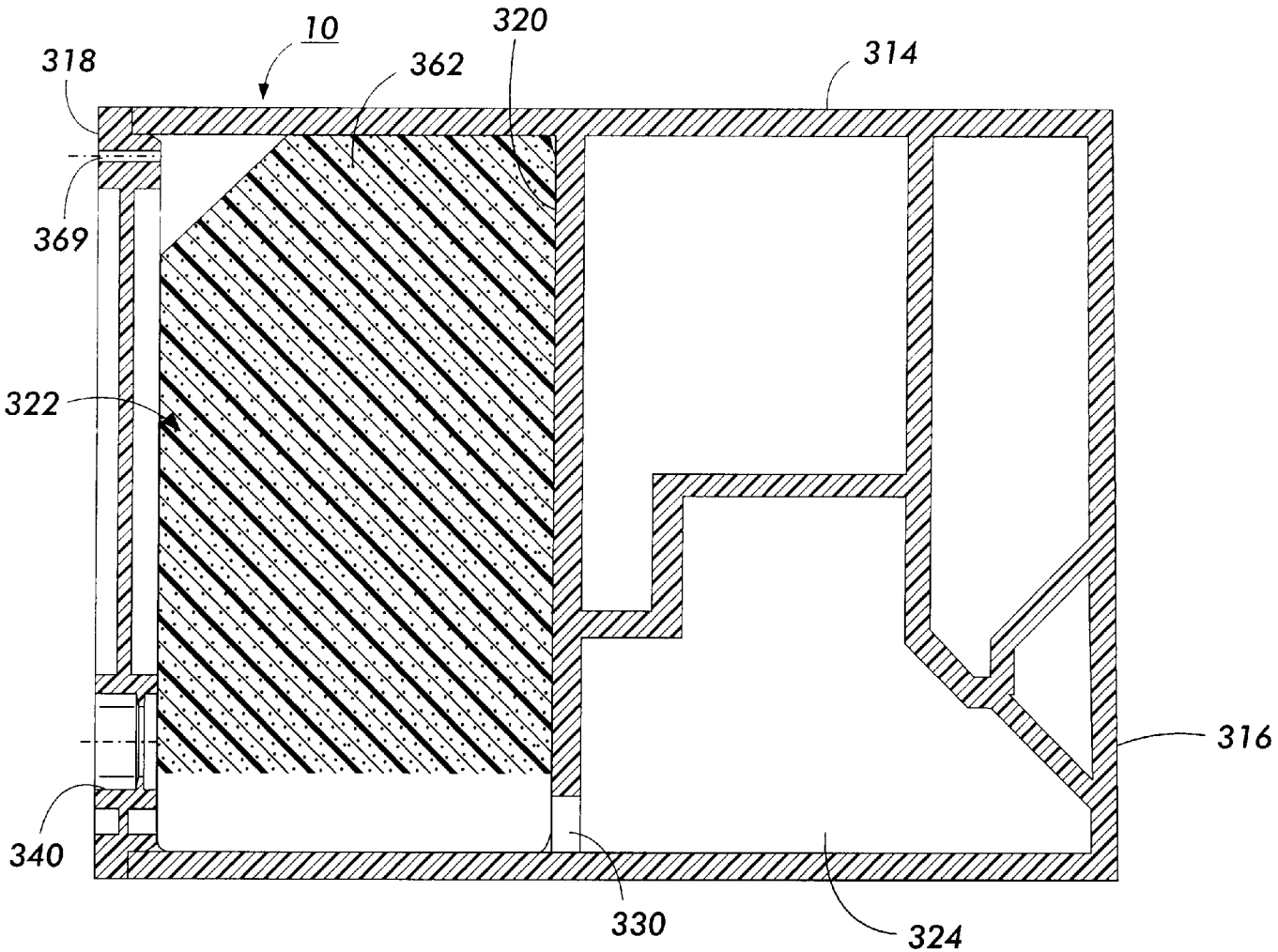
FIG. 10 is a side cross-sectional view of a third embodiment of an ink cartridge incorporating an aspect of the present invention.

Yet another embodiment of an ink cartridge incorporating aspects of the present invention is shown in FIG. 10. The embodiment shown in FIG. 10 is substantially similar to the embodiment shown in FIGS. 8 and 9, except that a portion of the wick material 362 adjacent the vent opening 269 is removed.

Specific embodiments of the present invention have been described. After reading the above description those skilled in the art will identify various modifications that can be made to the embodiment described above without departing from the spirit of the invention. For example, other shapes of ink cartridges may incorporate aspects of the invention. Also, other shapes may be incorporated into the projections, or other structures may be used. In addition, the vent opening, the outlet opening, and other elements may be placed in different locations. Therefore, the above description is illustrative, and the scope of the invention is not to be limited to the embodiments described above.

We claim:

1. A method of filling a cartridge for supplying liquid ink on demand to an ink-jet printhead, wherein the cartridge comprises a housing defining a wick chamber and an ink chamber with a fluid conduit between the ink chamber and the wick chamber, the housing containing wick material in the wick chamber, and having a fluid opening through the housing into the wick chamber, the method comprising:

sealing the ink chamber so that the ink chamber has no opening except into the wick chamber;

evacuating gas from the ink chamber and the wick chamber; and supplying ink through the fluid opening into the wick chamber until the ink flows through the fluid conduit into the ink chamber; and after the supplying ink step, raising the pressure inside the wick chamber to a predetermined pressure.

2. The method of claim 1, wherein the step of raising the pressure comprises raising the pressure at a controlled rate.

3. The method of 2, wherein the predetermined pressure is approximately equal to the general atmospheric pressure outside the housing.

4. The method of claim 3, wherein the step of raising the pressure inside the wick chamber comprises introducing gas to the interior of the wick chamber through the fluid opening.

5. The method of claim 4, wherein the step of introducing gas to the interior of the wick chamber comprises establishing fluid communication between the wick chamber and the atmosphere surrounding the housing.

6. The method of claim 1, additionally comprising after the step of raising the pressure, sealing the fluid opening.

7. A method of filling an ink jet printer cartridge, the method comprising:

providing a cartridge comprising a housing enclosing an interior space, wherein:

the interior space of the cartridge includes an ink-holding wick material;

the housing includes an inlet opening into the interior space having the ink-holding wick material;

the housing includes an outlet opening from the interior space having the ink-holding wick material;

sealing the outlet opening;

evacuating gases from the interior space through the inlet opening; and supplying ink through the inlet opening into the ink-holding wick material;

wherein:

the step of providing a cartridge comprises providing a cartridge in which the interior space includes a wick chamber and a free ink chamber, wherein the ink-holding wick material is in the wick chamber, and wherein a fluid conduit connects the wick chamber and the free ink chamber;

the step of supplying ink through the inlet opening comprises:

supplying ink into the wick material in the wick chamber; and continuing to supply ink into the wick material until ink flows through the fluid conduit into the free ink chamber; and the step of evacuating gasses from the interior space comprises:

sealing to the inlet opening a first end of a conduit; and connecting a vacuum source to a second end of the conduit; and the step of supplying ink into the wick material in the wick chamber comprises connecting the second end of the conduit to an ink supply while the first end of the conduit is sealed to the inlet opening, and flowing ink through the conduit to the inlet opening; and additionally comprising, after the step of supplying ink through the inlet opening, raising the pressure inside the wick chamber to a predetermined pressure.

8. The method of claim 7, wherein the step of raising the pressure inside the wick chamber comprises opening the second end of the conduit to atmospheric pressure.

9. The method of claim 8, wherein the step of opening the second end of the conduit to atmospheric pressure comprises gradually opening the second end of the conduit.

* * * * *